US008622538B2

(12) United States Patent
Miyakoshi et al.

(10) Patent No.: US 8,622,538 B2
(45) Date of Patent: Jan. 7, 2014

(54) RECORDING APPARATUS AND RECORDING METHOD

(75) Inventors: Toshimori Miyakoshi, Yokohama (JP); Yuji Kanome, Yokohama (JP); Susumu Hirosawa, Tokyo (JP); Kentarou Muro, Tokyo (JP); Yutaka Kano, Yokohama (JP); Hikaru Watanabe, Yokohama (JP); Takashi Horiba, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 267 days.

(21) Appl. No.: 12/945,366

(22) Filed: Nov. 12, 2010

(65) Prior Publication Data

US 2011/0109710 A1 May 12, 2011

(30) Foreign Application Priority Data

Nov. 12, 2009 (JP) ..... 2009-258799
May 6, 2010 (JP) ..... 2010-106622
May 6, 2010 (JP) ..... 2010-106717

(51) Int. Cl.

| | |
|---|---|
| ***B41J 2/01*** | (2006.01) |
| ***B41J 2/195*** | (2006.01) |
| ***B41J 29/38*** | (2006.01) |
| ***B41J 2/17*** | (2006.01) |

(52) U.S. Cl.
USPC ..... 347/101; 347/16; 347/7; 347/97

(58) Field of Classification Search
USPC ..... 347/7, 16, 17, 101, 102, 103, 104
See application file for complete search history.

(56) References Cited

U.S. PATENT DOCUMENTS

| | | | | |
|---|---|---|---|---|
| 4,850,118 | A * | 7/1989 | DeVillez | 34/557 |
| 5,287,123 | A * | 2/1994 | Medin et al. | 347/17 |
| 5,632,201 | A * | 5/1997 | Roch | 101/211 |
| 5,764,263 | A | 6/1998 | Lin | |
| 6,505,928 | B1 * | 1/2003 | Landau et al. | 347/102 |
| 6,536,863 | B1 | 3/2003 | Beauchamp et al. | |
| 6,663,238 | B2 * | 12/2003 | Kikuchi et al. | 347/102 |

(Continued)

FOREIGN PATENT DOCUMENTS

| | | |
|---|---|---|
| EP | 1625893 A1 | 2/2006 |
| EP | 1642720 A1 | 4/2006 |

(Continued)

OTHER PUBLICATIONS

Communication—Appln No. 10190870.5-1251 European Search Report, European Patent Office, Feb. 15, 2011.

(Continued)

*Primary Examiner* — Stephen Meier
*Assistant Examiner* — Leonard S Liang
(74) *Attorney, Agent, or Firm* — Fitzpatrick, Cella, Harper & Scinto

(57) ABSTRACT

First humidified gas is supplied from a first supply port to a sheet to be conveyed, thereby increasing the moisture content of the sheet. Simultaneously, second humidified gas is supplied to a space where nozzles of the inkjet recording head are exposed, from a second supply port provided at a position closer to the inkjet recording head than the first supply port, thereby increasing the atmosphere humidity of the space. The part of the sheet of which the moisture content has been increased is made to enter the space where the atmosphere humidity has been increased, and recording is performed by the inkjet recording head.

14 Claims, 7 Drawing Sheets

(56) References Cited

U.S. PATENT DOCUMENTS

| | | | | |
|---|---|---|---|---|
| 6,854,842 | B2 * | 2/2005 | Martin et al. | 347/102 |
| 7,058,347 | B2 * | 6/2006 | Uejima et al. | 399/341 |
| 8,038,281 | B2 * | 10/2011 | Kwong et al. | 347/102 |
| 8,182,080 | B2 * | 5/2012 | Kawakami et al. | 347/102 |
| 2003/0007055 | A1 * | 1/2003 | Ogawa | 347/102 |
| 2003/0137572 | A1 * | 7/2003 | Miyamoto et al. | 347/102 |
| 2005/0253912 | A1 * | 11/2005 | Smith et al. | 347/102 |
| 2008/0239043 | A1 * | 10/2008 | Nakazawa | 347/102 |
| 2010/0066771 | A1 * | 3/2010 | Hiratsuka et al. | 347/1 |
| 2010/0079515 | A1 * | 4/2010 | Kuwahara et al. | 347/7 |
| 2010/0218718 | A1 | 9/2010 | Ichimura et al. | |

FOREIGN PATENT DOCUMENTS

| | | | |
|---|---|---|---|
| JP | 55-041240 | A | 3/1980 |
| JP | 07-120025 | A | 5/1995 |
| JP | 2000255053 | A | 9/2000 |
| JP | 2006-044021 | A | 2/2006 |
| JP | 2007-106511 | A | 4/2007 |
| JP | 2008-023822 | A | 2/2008 |
| JP | 2008-138982 | A | 6/2008 |
| JP | 2009083475 | A | 4/2009 |

OTHER PUBLICATIONS

U.S. Appl. No. 12/876,436, filed Sep. 7, 2010.

U.S. Appl. No. 12/963,660, filed Dec. 9, 2010.

U.S. Appl. No. 12/964,109, filed Dec. 9, 2010.

Notification of First Office Action Appln. No. 201010543911.0—State Intellectual Property Office of the People's Republic of China, mailed Mar. 18, 2013.

* cited by examiner

RECORDING APPARATUS AND RECORDING METHOD

BACKGROUND OF THE INVENTION

1. Field of the Invention

The present invention relates to an inkjet recording apparatus and a recording method capable of suppressing drying of ink of an inkjet recording head.

2. Description of the Related Art

In a printer in which a plurality of inkjet recording heads are lined up side by side along a sheet conveying direction, a technique of supplying and flowing humidified gas in the vicinity of nozzles of a recording head from the upstream, thereby moisturizing the recording head to suppress ink drying is disclosed in Japanese Patent Application Laid-Open No. 2000-255053.

SUMMARY OF THE INVENTION

Sheets made of materials, such as paper, have an equilibrium moisture content according to humidity (state where the moisture of a sheet does not change any further), the moisture in the gas is absorbed if humidity is high, and the moisture in the sheet is lost if humidity is low. When a sheet is supplied to the vicinity of a recording head in a state where humidified gas is fed in and the humidity has increased, absorption of the moisture by the sheet occurs. Therefore, there is a possibility that a decrease in the humidity of the atmosphere may occur, and the recording head cannot be appropriately moisturized. Particularly in a configuration in which a plurality of recording heads are lined up side by side along the introduction direction of the humidified gas, it takes substantial time until the humidified gas supplied from the upstream is transmitted to the downstream. During this time, if moisture is absorbed by the sheet, moisturizing of a downstream recording head tends to become insufficient. If moisturizing is insufficient, this causes poor ink discharge, for example, discharge of ink becomes impossible or the discharge direction is disordered. Additionally, since large energy is needed for generation of humidified gas, a device in which efficient humidification is made is desired.

The present invention has been made based on recognition of the aforementioned problems. The object of the present invention is to provide a recording apparatus capable of properly maintaining the moisturizing of recording heads and capable of suppressing poor discharge from the recording heads.

A first aspect of the present invention is directed to a method which performs recording on a sheet to be conveyed with a recording head of an inkjet type in which nozzles are formed, the method comprising a first step of supplying first humidified gas to the sheet with a first supply port, a second step of supplying second humidified gas to a space where the nozzles are exposed with a second supply port, and a third step of performing, using the recording head, recording on a part of the sheet which has entered the space where atmosphere humidity has been increased in the second step, after moisture content of the part of the sheet has been increased in the first step.

A second aspect of the present invention is directed to an apparatus comprising a recording unit including an recording head of an inkjet type in which nozzles are formed, a first supply port for supplying first humidified gas to a sheet to be conveyed, and a second supply port for supplying second humidified gas to a space where the nozzles are exposed, the second supply port is provided at a position between to the recording head and the first supply port in a direction in which the sheet is conveyed.

According to the present invention, absorption of moisture by a sheet is suppressed by humidifying the sheet in advance, moisturizing of the recording heads can be appropriately maintained, and poor discharge of ink can be suppressed.

Further features of the present invention will become apparent from the following description of exemplary embodiments.

DESCRIPTION OF THE EMBODIMENTS

Preferred embodiments of the present invention will now be described in detail in accordance with the accompanying drawings.

Figure 1:
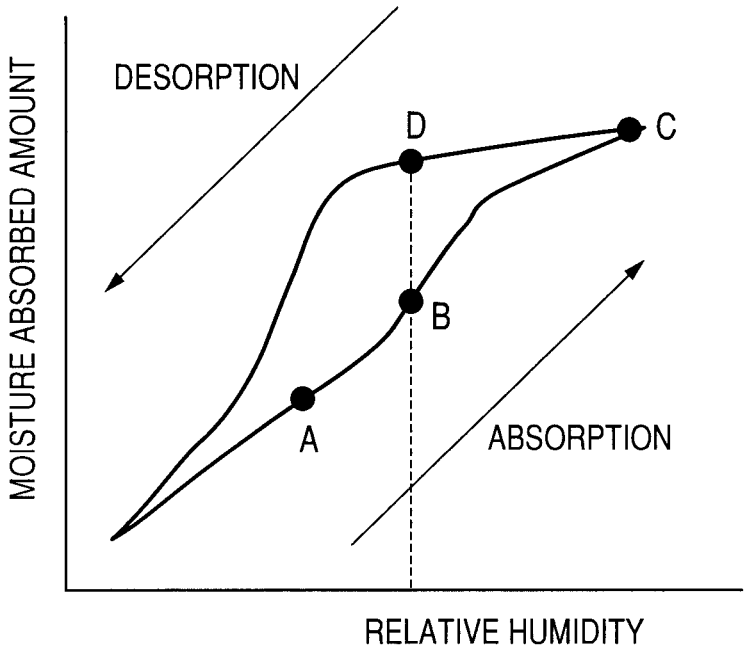
FIG. 1 is a view illustrating the hysteresis characteristics of a sheet.

Prior to description of embodiments of the present invention, the hysteresis characteristics of a sheet which is a recording medium, for example, an inkjet glossy paper will be described. FIG. 1 illustrates the hysteresis characteristics related to absorption and desorption of moisture. As for papers, such as an inkjet glossy paper, the relation between absorption and desorption of moisture according to a change in relative humidity is not linear. If atmosphere humidity has changed from a point A where relative humidity is low to a point B where the relative humidity is high, the inkjet glossy paper absorbs the moisture in atmosphere. On the other hand, if the relative humidity is lowered from a point C where the relative humidity is higher to the same relative humidity as the point B, the amount of moisture that the inkjet glossy paper contains amounts to the amount of a point D larger than the point B. That is, if the inkjet glossy paper is exposed to a certain relative atmosphere humidity, the inkjet glossy paper can contain a larger amount of moisture when the relative humidity is changed from a state where the relative humidity is high than when the relative humidity is changed from a state where the relative humidity is low. Moreover, if the relative humidity is changed to the relative humidity of the point D from the point C where the relative humidity is higher, the amount of moisture which leaves the inkjet glossy paper is small. Therefore, if the inkjet glossy paper is exposed again to the relative humidity of the point C or points thereabove, the amount of moisture that the inkjet glossy paper absorbs is smaller when the relative humidity is changed from the point D than when the relative humidity is changed from the point B.

That is, if moisture is intentionally made to be absorbed to a sheet before the sheet is conveyed to the recording unit, the absorption of moisture to the sheet can be suppressed even in a state where the relative humidity in the recording unit is high. Therefore, since the absorption of moisture by a sheet is suppressed even if the relative humidity around a recording head is increased so that ink does not evaporate from the recording head, the state where the relative humidity around the recording head has been increased can be maintained, and drying of the ink can be suppressed. The present invention has been made based on such consideration.

Figure 2:
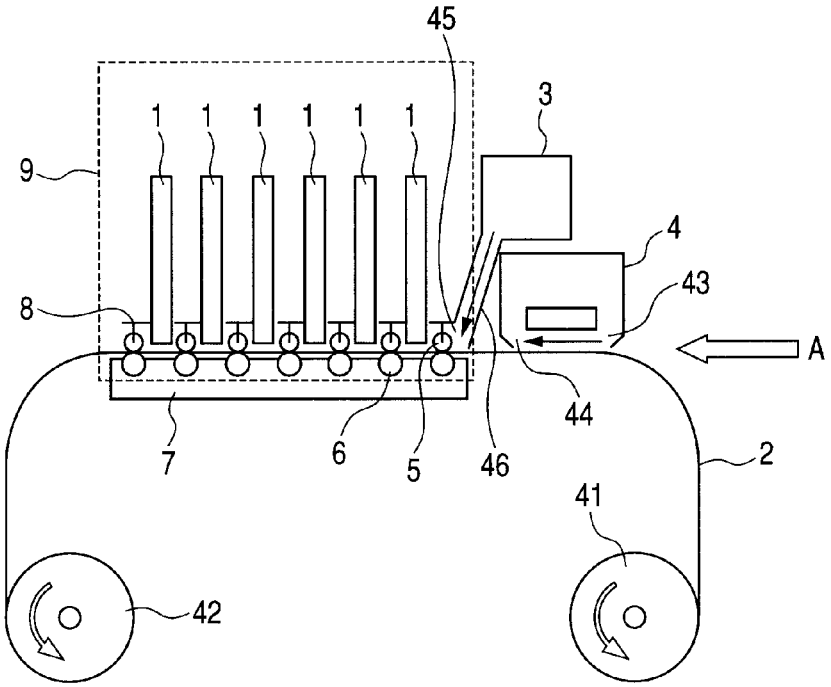
FIG. 2 is a configuration diagram of an inkjet recording apparatus of an embodiment.
Figure 3:
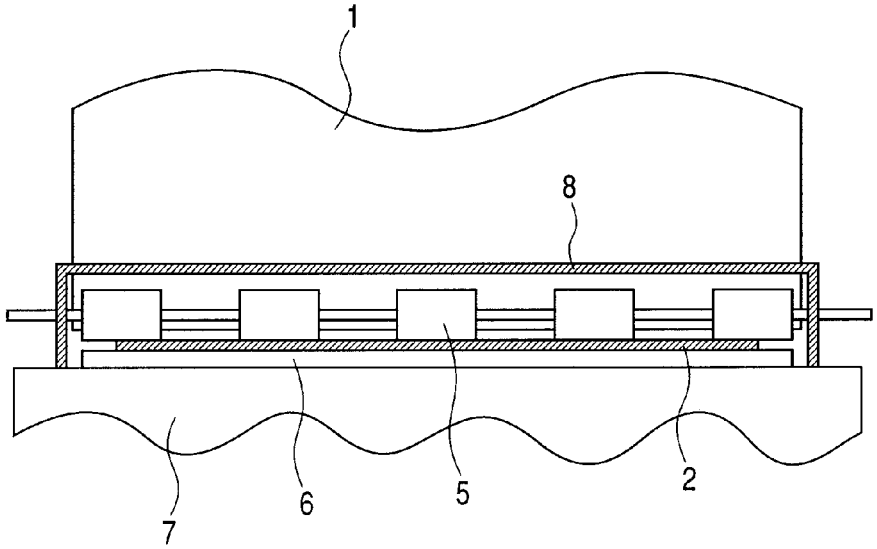
FIG. 3 is a view when a recording unit is seen from the direction A.

FIG. 2 is a configuration diagram of an inkjet recording apparatus related to an embodiment of the present invention, and FIG. 3 is a configuration diagram when a recording unit 9 of the inkjet recording apparatus of FIG. 2 is seen from the direction A. Black arrows in the drawing indicate the flow of humidified gas. In addition, although humidified air is considered in the present embodiment, humidified gases other than air may be considered. Additionally, in the present specification, the direction closer to the sheet supply side at an arbitrary position in the sheet conveying path is referred to as "upstream", and the side opposite to the sheet supply side is referred to as "downstream".

The recording apparatus of the present embodiment is a so-called roll-to-roll system. A supply roller 41 supplies a sheet 2 which is a continuous sheet wound in the shape of a roll. A winding roller 42 winds the sheet with which has been subjected to recording in a recording unit 9 in the shape of a roll.

The recording unit 9 has a housing illustrated by a dotted line of FIG. 2, a conveying mechanism and the recording unit are provided and integrated inside the housing. The conveying mechanism has a platen 7 which assists in supporting the sheet 2, and a plurality of roller pairs each including a driving roller 6 and a driven roller 5. The driving roller 6 is partially embedded in the platen 7 in a rotatable state, and is rotated by a drive source to convey a sheet. The driven roller 5 is supported by a support member 8 (holder), and is arranged at a position where the driven roller faces the driving roller 6 with the sheet 2 therebetween. A recording head 1 which constitutes the recording unit is provided between the roller pairs of the driving roller 6 and the driven roller 5. The recording head 1 is a fixed full line type head, which is a line type inkjet recording head in which nozzles which discharge ink are formed across the maximum recording width in the width direction of the sheet 2. Although the inkjet type is a type using heating elements in the present embodiment, the inkjet type is not limited thereto, and can also be applied to a type using piezoelectric elements, electrostatic elements, or MEMS (Micro Electro Mechanical Systems) elements. The recording heads 1 are lined up in the conveying direction in numbers matching the number of colors (six colors in FIG. 2) along the conveying direction of the sheet, and the plurality of recording heads 1 are integrally held by the support member 8. Ink is supplied to the recording head 1 from an ink tank. In addition, each recording head 1 may be formed as a unit integral with an ink tank which stores a corresponding color ink. The recording unit 9, which is of a line print type, imparts each color ink to a sheet 2 which is moving, using the recording head 1 for each color, and forms an image. In addition, although roll paper is used as the sheet 2 in the present embodiment, any kind of sheet, such as continuous forms folded per unit length or cut sheets, are used.

A first supply unit 4 for supplying humidified gas is provided further upstream of the conveying path of a sheet than the recording unit 9. The first supply unit 4 performs humidification to the sheet 2, before the sheet 2 is conveyed to the recording unit 9. The first supply unit supplies humidified gas (first humidified gas) to the sheet 2 before entering the recording unit 9, and increases the moisture content of the sheet. The first supply unit 4 has a humidification device, a blower, a supply port 43 (first supply port), and an intake port 44. The gas (first humidified gas) within the first supply unit 4 humidified by the humidification device is supplied from the supply port 43 by the blower and supplied to the sheet 2 before the sheet enters the recording unit 9. The intake port 44 may be provided at any position as long as gas can be taken into the first supply unit 4 through the intake port. It is more preferable to provide the intake port 44 at a position apart from the supply port 43 along the sheet 2, and to provide the supply port 43 in such a direction that the supply port 43 supplies humidified gas from a direction more parallel to the sheet 2, though not illustrated. Since the gas supplied from the supply port 43 can be taken in from the intake port 44 by doing in this way, the humidified gas can be circulated, and the amount of the water to be used in the humidification device can be reduced.

A second supply unit 3 which supplies humidified gas for humidifying a narrow space where the nozzles of the recording heads 1 within the recording unit 9 are exposed is provided independently from the first supply unit 4. The atmosphere humidity of the narrow space where the nozzles of a plurality of recording heads 1 are exposed can be increased by sending in humidified gas (second humidified gas) from a sheet inlet of the recording unit 9 by the second supply unit 3. This moisturizes the nozzles of the plurality of recording heads, thereby suppressing drying. The second supply unit 3 is provided with a humidification device, a blower, and an intake port. A supply duct 46 is connected to the second supply unit 3, and the tip of the supply duct 46 serves as a supply port 45 (second supply port) which supplies humidified gas. The supply port 45 is provided near the sheet inlet of the recording unit 9 to supply humidified gas (second humidified gas) to a narrow space within the recording unit 9 from the supply port 45. The supply port 43 and intake port 44 of the first supply unit 4 are located further upstream than the supply port 45 of the second supply unit 3 as seen from the recording unit 9. Since the humidified gas generated in the second supply unit 3 is introduced to the supply port 45 through the supply duct 46, the humidified gas generating unit of the second supply unit 3 does not need to be located between the recording unit 9 and the first supply unit 4.

The humidified gas supplied by the second supply unit 3 flows downstream from the upstream through the conveying path of the sheet 2 and the narrow space in the vicinity thereof in the recording unit 9. Specifically, the humidified gas passes through a gap (hereinafter referred to as a "recording gap") between the tip (surface in which the nozzles are formed) of the recording head 1, and the sheet 2, at the position of the recording head 1. Additionally, the humidified gas passes through the gap formed between the support member 8 and the sheet 2 between adjacent recording heads 1. That is, the humidified gas is transmitted to downstream recording heads 1, passing through two kinds of gaps. In the inkjet type, the recording gap is usually as narrow as around 1 mm. When humidified gas passes through the recording gap, the flow velocity of the humidified gas increases. As a result, when recording is performed, this may exert a bad influence upon the landing accuracy of a discharge droplet (a main drop and a satellite drop) discharged from the recording head 1.

Accordingly, the humidified gas supplied from the second supply unit 3 is desirably set so that the flow velocity in the recording gap becomes 1 m/sec or lower.

Figure 4:
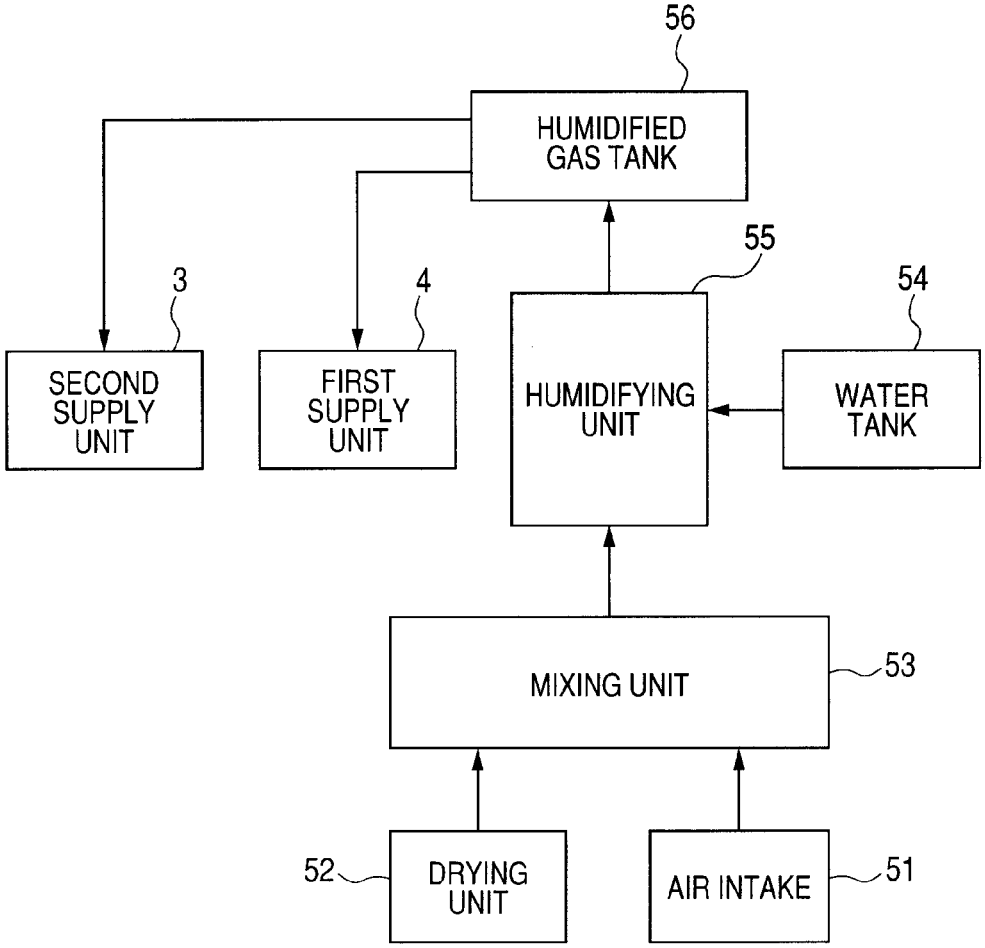
FIG. 4 is a system chart of an example of a humidification device.

FIG. 4 is a system chart of the first supply unit 4, the second supply unit 3, and the humidified gas supply unit that supplies humidified gas to these units. The ambient air supplied from the air intake 51 and the dry gas supplied from the drying unit 52 are mixed within a mixing unit 53, and are turned into mixed gas having a temperature suitable as humidified gas. The drying unit 52 is a unit for forcedly drying the sheet which has subjected to recording in the recording unit 9 and gets wet with ink, before the sheet is wound around the winding roller 42 (not illustrated in FIG. 2). High-humidity and high-temperature gas is discharged from the drying unit 52, and a part of this energy is used for generation of humidified air. The water supplied from a water tank 54 is mixed with the mixed air sent from the mixing unit 53 in a humidifying unit 55, and humidified gas having the temperature and humidity required for supply of humidified gas to the sheet 2 is produced. The humidified gas produced in the humidifying unit 55 is once stored in a humidified gas tank 56. Then, the humidified gas supply unit is operated so that a certain amount of humidified gas required during recording is sent into the first supply unit 4 and the second supply unit 3, respectively, and the humidification performance required for the sheet 2 is obtained. In addition, a heater is arranged in the mixing unit 53 and the humidifying unit 55 so that the mixed gas and the humidified gas can be finely adjusted to an optimal temperature.

The humidity of the first humidified gas supplied from the first supply unit 4 and the humidity of the second humidified gas supplied from the second supply unit 3 will be described. It is necessary to make the atmosphere around the recording head 1 into an atmosphere in which ink does not evaporate easily from the recording head 1. For example, if temperature is 30 to 40° C., relative humidity is about 60 to 70%. Therefore, in the second supply unit 3, it is preferable to set the relative humidity to about 60 to 70%. However, the relative humidity is not limited to this if ink can be kept from evaporating from the recording head 1. In the first supply unit 4, it is preferable to make moisture absorbed on the sheet 2 so as to obtain an equilibrium moisture content. The amount of moisture which can be absorbed according to the kinds of sheet 2 varies. Accordingly, as a standard, the gas which has been humidified to the absolute humidity nearly equal to or higher than the absolute humidity of the humidified gas supplied from the second supply unit 3 may be supplied to the sheet 2 from the first supply unit 4.

Figure 5:
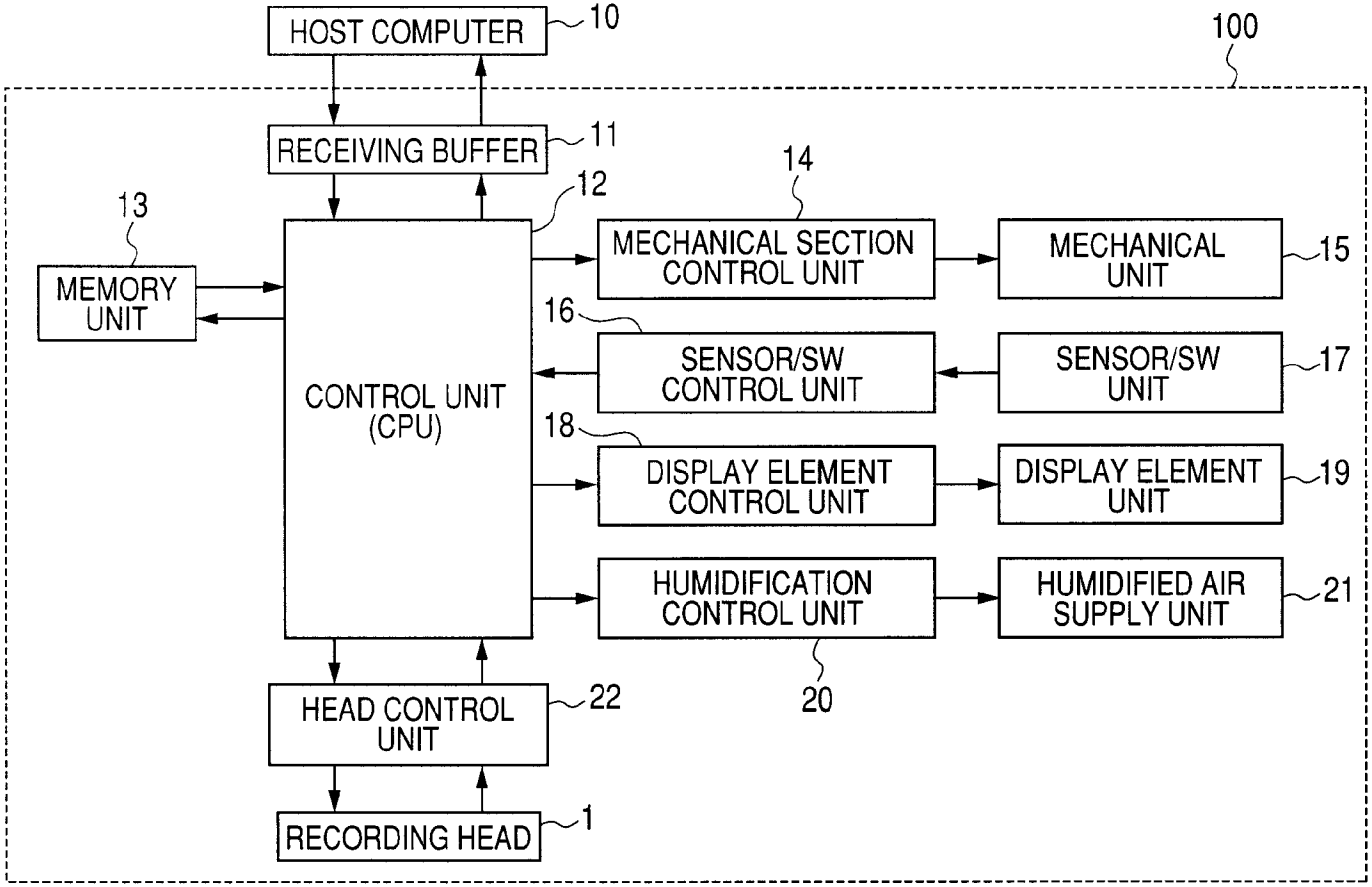
FIG. 5 is a block diagram of a control system.

FIG. 5 is a block diagram of a control system of the inkjet recording apparatus 100 of this embodiment. The text or image data to be recorded is input to a receiving buffer 11 of the inkjet recording apparatus from a host computer 10. Additionally, data which checks whether or not data is properly transmitted, or data which indicates the operating state of the inkjet recording apparatus are output to the host computer 10 from the inkjet recording apparatus. The data of the receiving buffer 11 is transmitted to a memory unit 13 and temporarily stored in a RAM, based on the management of a CPU 12 which is a control unit. A mechanical unit control unit 14 drives a mechanism unit (mechanical unit) 15 of a line head carriage, a cap, a wiper, and the like through a command from the CPU 12. A sensor/SW (switch) control unit 16 sends a signal from a sensor/SW unit 17 including various sensors or SW (switches) to the CPU 12. A display element control unit 18 controls a display element unit 19 including an LED of a display panel, a liquid-crystal display element, and the like through a command from the CPU 12. A humidification control unit 20 controls a humidified gas supply unit 21 (system illustrated in FIG. 4) by a command from the CPU 12. At this time, the CPU 12 determines the amount of moisture to be supplied to the sheet 2, from various kinds of information, for example, environmental temperature, the kind or thickness of the sheet 2, the temperature of a line head, the hitting amount of the image data to be recorded, and the like, and performs setting of the humidification conditions of the humidified gas supply unit 21. A recording head control unit 22 controls driving of the recording head 1 by a command from the CPU 12, and detects the temperature information showing the state of the recording head 1 to transmit the information to the CPU 12.

In the above configuration, the first supply unit 4 is provided further upstream of the conveying path of a sheet than the recording unit 9, and supplies the first humidified gas to the sheet before entering the recording unit 9. Thereby, the moisture content of a sheet is increased before the sheet enters the recording unit 9. The second supply unit 3 supplies the second humidified gas from the sheet inlet so that the humidified gas may flows downstream from the upstream through the conveying path of the recording unit 9. In the recording unit 9, the second humidified gas is sent in before a sheet is introduced, and the atmosphere humidity of a narrow space where the nozzles of the recording head 1 are exposed is increased, whereby the moisturizing (humidity retention) of the recording head is performed. Additionally, if this is regarded as an operation, in the first step, the first humidified gas is supplied from the first supply port to the sheet to be conveyed, thereby increasing the moisture content of the sheet. Simultaneously, in the second step, the humidity retention of the nozzles is performed by supplying the second humidified gas to a narrow space where the nozzles are exposed, from the second supply port provided at a position closer to the recording head than the first supply port, thereby increasing the atmosphere humidity of the narrow space. Then, in the third step, the part of the sheet of which the moisture content has been increased in the first step is made to enter a narrow space where the atmosphere humidity has been increased in the second step, and recording is performed by the inkjet recording head.

Thereby, since a sheet is in a state where the moisture content has been increased by the first humidified gas in advance when the sheet passes through a space during recording, the sheet is kept from absorbing the moisture of the second humidified gas. Therefore, high humidity continues being maintained in a narrow space from an upstream recording head to a downstream recording head, and the nozzles are reliably moisturized. As a result, occurrence of poor ink discharge such that discharge of ink becomes impossible or a discharge direction is disordered is suppressed.

Figure 8:
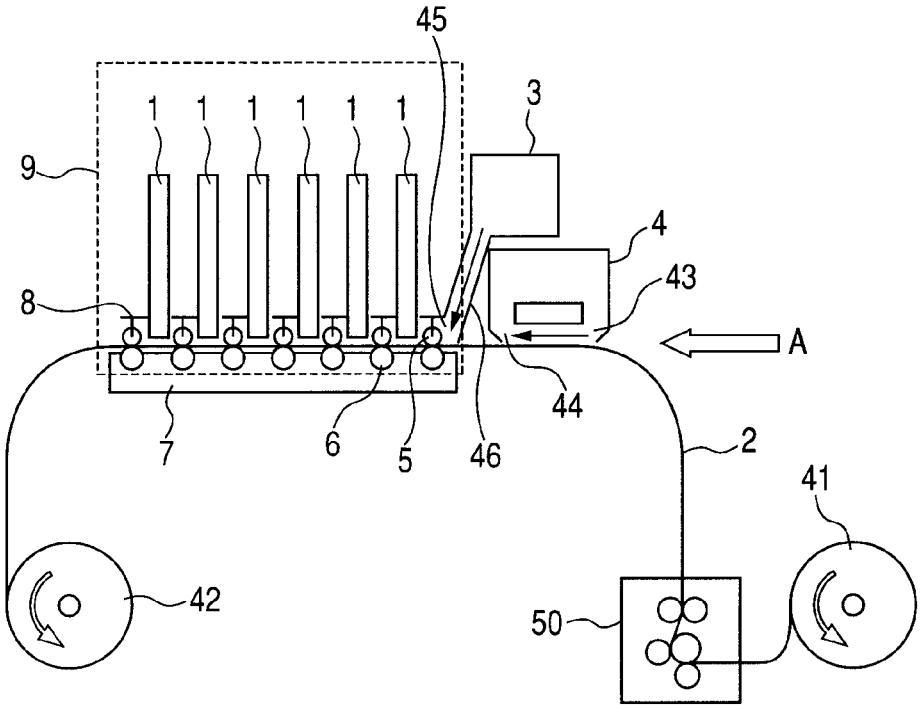
FIG. 8 is a configuration diagram of an inkjet recording apparatus of a second embodiment.

A second embodiment will be described with reference to FIG. 8. The same reference numerals as the above-described embodiment represent the same members. In the present embodiment, a decurling mechanism 50 is provided between the supply roller 41 which supplies the sheet 2, and the recording unit 9. That is, the first supply unit 4 is located closer to the recording unit 9 than the decurling mechanism 50. The decurling mechanism 50 includes a heater which heats a sheet. Curling of a sheet which is caused by winding of the sheet around the supply roller 41 is corrected as the sheet is conveyed while being heated by the heater of the decurling mechanism 50. Decurling is more effectively performed by heating a sheet using the heater.

If the first supply unit 4 is arranged between the decurling mechanism 50 and the supply roller 41, a sheet passes through the decurling mechanism 50 after moisture is supplied to the surface of the sheet by the humidified gas from the first supply unit 4. The sheet is heated by the heater of the decurling mechanism 50, much of moisture of the sheet which has been absorbed evaporates, and the sheet returns to a state where much moisture can be absorbed. When a sheet passes through the recording unit 9, the sheet absorbs the moisture of a narrow space in large quantities, and the atmosphere humidity decreases. Therefore, the moisturizing of the recording head 1 becomes imperfect, and such a tendency becomes noticeable particularly near the tip of the recording head 1 on the furthest downstream side.

In order to avoid such a situation, the first supply unit 4 is arranged between the decurling mechanism 50 and the recording unit 9. That is, there is a provided an arrangement relation in which the decurling mechanism 50 is provided further upstream of the sheet conveying path than the first supply port 43 of the first supply unit 4. As illustrated in FIG. 8, the first supply unit 4 is preferably arranged so as to be adjacent to the recording unit 9 immediately before the recording unit as much as possible. This is because the time until the sheet 2 arrives at the recording unit 9 after the sheet absorbs moisture in the first supply unit 4 can be shortened, and moisture evaporation can be kept low.

Figure 9:
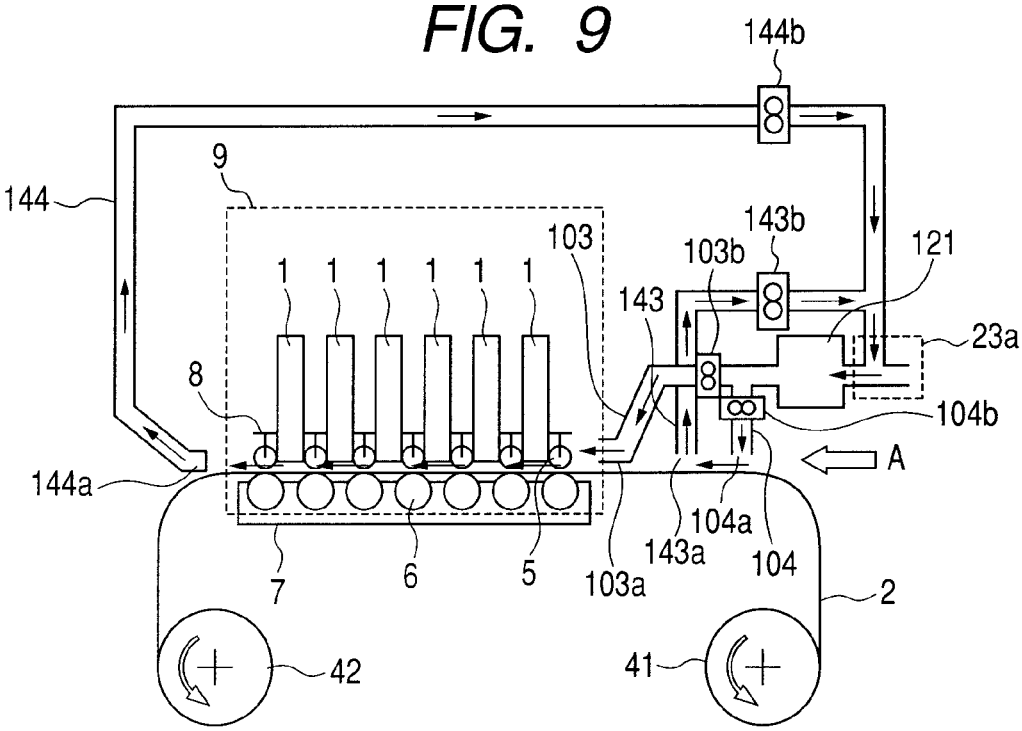
FIG. 9 is a configuration diagram of an inkjet recording apparatus of a third embodiment.

A third embodiment of the present invention will be described with reference to FIG. 9. A first humidification duct 104 and a recovery duct 143 are provided further upstream of the sheet conveying path than the recording unit 9. The first humidification duct 104 supplies the humidified gas, which is produced by the humidified gas generating unit 121, from the supply port 104*a* (first supply port), and blows the gas against the sheet 2. The first humidification duct 104 supplies humidified gas (first humidified gas) to the sheet 2 before entering the recording unit 9, and increases the moisture content of the sheet. A blower fan 104*b* for generating an gas stream is provided partway along the first humidification duct 104.

A part of the humidified gas of which absorption to the sheet 2 has not been performed in the humidified gas blown against the sheet 2 from the first humidification duct 104 is sucked in and recovered from a recovery port 143*a* of the recovery duct 143, and is returned to an inlet 23*a* of the humidified gas generating unit 121. In order to generate an gas stream for returning, a blower fan 143*b* is provided partway along the recovery duct 143. In addition, as long as the recovery duct 143 can recover the humidified gas from the first humidification duct 104 of which absorption to the sheet 2 has not been performed, the position of the recovery port 143*a* may be anywhere. The blower fan 104*b* and the blower fan 143*b* rotate so that the flow rate of the humidified gas supplied from the supply port 104*a* and the flow rate of the humidified gas recovered by the recovery duct 143 become equivalent (means that the flow rates are equal or approximately equal to each other). The humidified gas returned by the recovery duct 143 is introduced into the humidified gas generating unit 121, and is reused. Since the use efficiency of the humidified gas increases by virtue of this reuse, consumption of humidifying water is suppressed. Additionally, since the humidified gas is kept from being diffused to other units of the recording apparatus, troubles with the electric system caused by dew condensation, the corrosion of metal parts accompanying prolonged use, or the like hardly occur.

A second humidification duct 103 for sending humidified gas into a narrow space where the nozzles of the recording head 1 in the recording unit 9 are exposed is provided independently from the first humidification duct 104. The atmosphere humidity of the narrow space where the nozzles of a plurality of recording heads 1 are exposed can be increased by sending in humidified gas (second humidified gas) from a sheet inlet of the recording unit 9 by the second humidification duct 103. This moisturizes the nozzles of the plurality of recording heads, thereby suppressing drying. The second humidification duct 103 includes a blower fan 103*b* partway along thereof, and supplies the humidified gas, which is produced by the humidified gas generating unit 121, from the supply port 103*a* (second supply port). The supply port 103*a* is provided near the sheet inlet of the sheet 2 of the recording unit 9. The recovery port 143*a* of the recovery duct 143 and the supply port 103*a* of the second humidification duct 103 are located further upstream the supply port 104*a* of the first humidification duct 104 as seen from the recording unit 9.

The humidified gas supplied by the second humidification duct 103 flows downstream from the upstream through the conveying path of the sheet 2 and the narrow space in the vicinity thereof in the recording unit 9. Specifically, the humidified gas passes through a gap (hereinafter referred to as a "recording gap") between the tip (surface in which the nozzles are formed) of the recording head 1, and the sheet 2, at the position of the recording head 1. Additionally, the humidified gas passes through the gap formed between the support member 8 and the sheet 2 between adjacent recording heads 1. The humidified gas is transmitted to downstream recording heads 1, passing through two kinds of gaps. In the inkjet type, the recording gap is usually as narrow as around 1 mm. When humidified gas passes through the recording gap, the flow velocity of the humidified gas increases. As a result, when recording is performed, this may exert a bad influence upon the landing accuracy of a discharge droplet (a main drop and a satellite drop) discharged from the recording head 1. Accordingly, the humidified gas supplied from the second humidification duct 103 is desirably set so that the flow velocity in the recording gap becomes 1 m/sec or lower.

In order to recover at least a part of the humidified gas which has flowed downstream from the upstream through the conveying path of the sheet 2 and the narrow space in the vicinity thereof in the recording unit 9, and to reintroduce the recovered humidified gas into the humidified gas generating unit 121, a return duct 144 is provided. The return duct 144 is provided with an intake port 144*a*, and a blower fan 144*b* for generating an gas stream. The intake port 144*a* is provided near a sheet inlet of the recording unit 9 so as to efficiently recover the humidified gas which has flowed downstream from the upstream along the sheet conveying path. The humidified gas returned by the return duct 144 is introduced into the humidified gas generating unit 121, and is reused. By virtue of the above-described two recovery mechanisms including the recovery duct 143 and the return duct 144, the use efficiency of humidified gas is significantly high, the consumption of humidifying water is small, and the humidified gas is kept from being diffused to other units of the recording apparatus.

Figure 10:
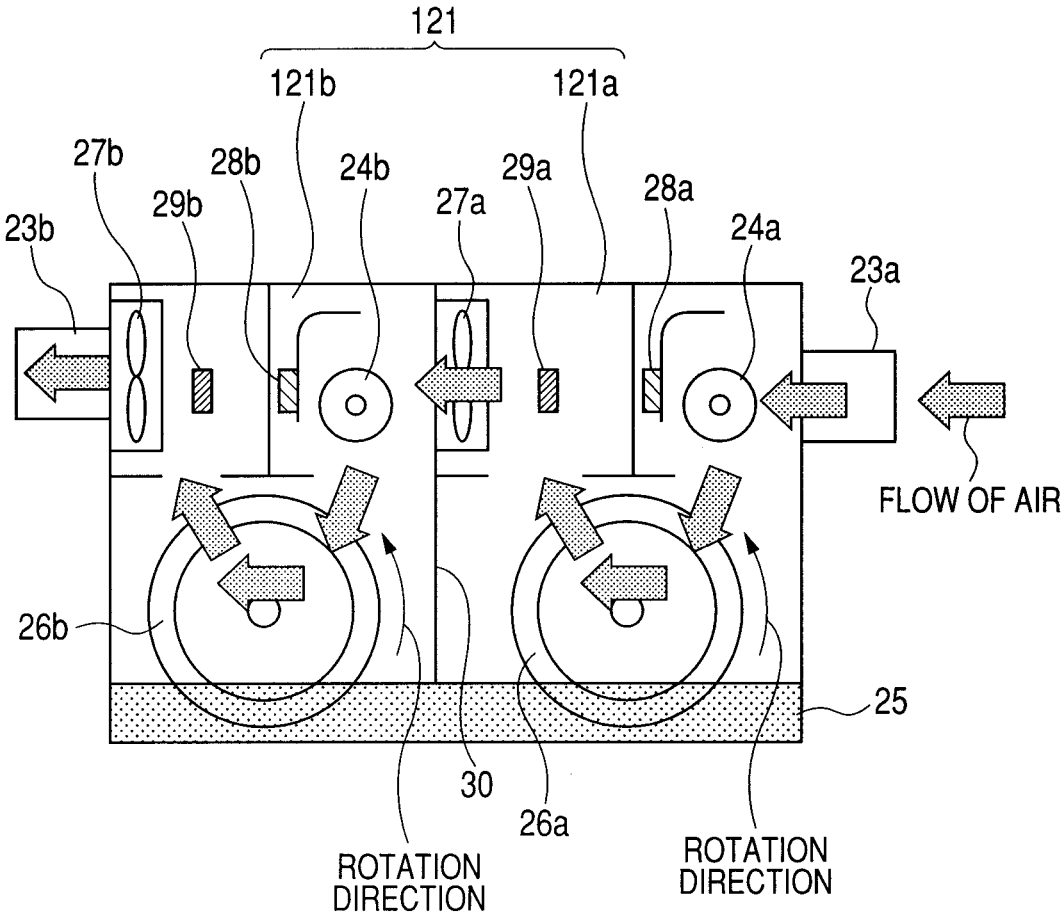
FIG. 10 is a configuration diagram illustrating the detailed structure of a humidified gas generating unit.

FIG. 10 is a configuration diagram illustrating a detailed structure of the humidified gas generating unit 121. In the humidified gas generating unit 121, a first humidification chamber 121*a* and a second humidification chamber 121*b* are connected in series, and the first humidification chamber 121*a* and the second humidification chamber 121*b* are received and integrated in one housing. The first humidification chamber 121*a* and the second humidification chamber 121*b* are partitioned by a wall 30 inside the housing. The first humidification chamber 121*a* is provided with an inlet 23*a*, a heating element 24*a* (heater), a humidification filter 26*a*, and a fan 27*a*. The first humidification chamber 121*a* is further provided with a temperature sensor 28*a* for detecting the temperature within the first humidification chamber 121*a* to control the amount of heat generation of the heating element

24*a*, and a temperature and relative humidity sensor 29*a* which measures the gas humidity within the first humidification chamber 121*a*. The second humidification chamber 121*b* is provided with a heating element 24*b*, a humidification filter 26*b*, a fan 27*b*, and a outlet 23*b*. The second humidification chamber 121*b* is further provided with a temperature sensor 28*b* for detecting the temperature within the second humidification chamber 121*b* to control the amount of heat generation of the heating element 24*b*, and a temperature and relative humidity sensor 29*b* which measures the gas humidity within the second humidification chamber 121*b*. Humidifying water 25 for humidification is accumulated at the bottom of the first humidification chamber 121*a* and the bottom of the second humidification chamber 121*b*. The humidifying water 25 is supplied from a tank (not illustrated). The first humidification chamber 121*a* and the second humidification chamber 121*b* are connected together at the bottoms thereof, and the humidifying water reserved at the bottoms is shared by the first humidification chamber 121*a* and the second humidification chamber 121*b*. In a state where the humidifying water 25 is accumulated, a wall 30 for partitioning the chamber is between the first humidification chamber 121*a* and the second humidification chamber 121*b*. However, there is no wall under the water surface of the humidifying water 25, and the humidifying water 25 is shared by the first humidification chamber 121*a* and the second humidification chamber 121*b*. In addition, as another aspect, all the first humidification chamber 121*a* and the second humidification chamber 121*b* may be partitioned by the wall 30, and the portions of both the chambers under the water surface may be connected together by a tube. By adopting such sharing, the height of the water surface of the humidifying water 25 becomes the same at the first humidification chamber 121*a* and the second humidification chamber 121*b*, and neither of the chambers runs short of water first. Although the humidifying water 25 is water (for example, tap water) which is easily supplied at low cost, the humidifying water is not limited, and any solution can be used which contains a component preventing the drying of ink of a recording head.

The humidified gas generating unit 121 is of a hybrid vaporized humidification type. Both the humidification filters 26*a* and 26*b* are hollow cylindrical (roller-shaped) rotating bodies made of a material which has high water absorptivity and allows gas to pass therethrough. Lower portions of the humidification filters 26*a* and 26*b* are immersed in the humidifying water 25, and the whole filters get wet as the filters rotate. If gas whose temperature has risen is blown against the humidification filters, the gas passes through one humidification filter inward from the outside, and then passes through the filter outward from the inside, thereby performing humidification twice in total. Since the gas passes through the humidification filters 26*a* and 26*b* twice, respectively, the gas passes through the filters four times in total. Both the humidification filters 26*a* and 26*b* rotate in the same direction. The rotation direction is counterclockwise in FIG. 3, i.e., is a rotation direction such that, when a hollow cylinder of a humidification filter is bisected right and left, the side (right side) closer to an inlet (heating element) to the humidification chamber comes up from the water surface of the humidifying water 25, and the side (left side) farther away from the inlet sinks under the water surface. The amount of water retained of a filter immediately after coming out of the water surface is larger, and decreases gradually with rotation. Accordingly, since a higher-temperature gas immediately after the temperature has been raised by a heating element passes through a filter in a state (state on the right) where the amount of water retained is larger, humidity efficiency becomes high. Since the first humidification chamber 121*a* and the second humidification chamber 121*b* are humidified with high efficiency, the humidity efficiency which is extremely high as a whole is obtained. By operating the fan 27*a* and the fan 27*b* simultaneously, the humidified gas, which is obtained when ambient air is introduced into the first humidification chamber 121*a* from the inlet 23*a*, passes through the inside of the chamber, and is humidified to high humidity, is exhausted from the outlet 23*b*. Control can be made so that the rotation number of the fans 27*a* and 27*b*, the amount of heat generation of the heating elements 24*a* and 24*b*, and the rotation speed of the humidification filters 26*a* and 26*b* are variably set, respectively. The operating capacity of the humidified gas generating unit 121 is variably adjusted by this control.

When it is intended to generate humidified gas having a humidity of the above-described numerical range in one humidification chamber, a larger humidifying unit than the two-chamber structure of this embodiment is needed. If an equivalent humidified gas is generated in one humidification chamber, the flow velocity of the gas which is made to pass through a humidification filter is reduced in order to increase vaporization efficiency. Therefore, in order to guarantee a desired flow rate, it is necessary to take a large passage area for the humidification filter. As a result, the size of the humidification filter becomes significantly large. According to this embodiment, since the number of times of passage through a humidification filter can be increased by splitting a humidification chamber and connecting together split chambers in series, the humidity efficiency is high, and humidification can be managed with a small humidification filter. Therefore, overall compactness is achieved. Therefore, a recording apparatus which is excellent in the size, cost, and energy efficiency of the whole apparatus is realized.

Since a chlorine component contained in humidifying water, fine dust, and the like are unnecessary components which become causes of clogging and the like in an ink nozzle, introduction of the component into the narrow space is not preferable. Since the humidification filters 26*a* and 27*b* are of a vaporization type, components other than water are trapped by a water absorption body of a humidification filter, and thereby scattering of the components to space is suppressed. That is, humidification of the vaporization type using a filter like this embodiment is suitable for moisturizing of an inkjet type recording head. From a different viewpoint, tap water which has many unnecessary components, but is easily supplied at low cost, can be used as humidifying water by adopting the vaporization type humidification.

According to the third embodiment, the humidified gas returned by the recovery duct 143 is returned to the humidified gas generating unit 121, and is reused. Additionally, at least a part of the humidified gas is returned to the humidified gas generating unit 121 even by the return duct 144, and is reused. For this reason, the use efficiency of the humidified gas increases, and consumption of humidifying water is suppressed. Additionally, since the humidified gas is kept from being diffused to other units of the recording apparatus, troubles with the electric system caused by dew condensation, corrosion of metal parts accompanying prolonged use, or the like hardly occur.

In addition, since the humidified gas generating unit 121 has a structure in which a plurality of humidification chambers are connected together in series, the humidity efficiency is high, and humidification can be managed with a small humidification filter. Therefore, overall compactness is achieved. Moreover, the humidified gas generating unit 121 is shared by the first humidification duct 104 and the second humidification duct 103. Therefore, a recording apparatus which is excellent in size, cost, and energy efficiency of the whole apparatus is realized.

Next, examples in which experiments are conducted using the inkjet recording apparatus of the configuration of FIG. 2 will be described.

EXAMPLE 1

Supposing that the recording heads 1 are six color recording heads of black, cyan, photo-cyan, magenta, photo-magenta, and yellow, which have a recording width of 6 inches. A gloss roll paper for inkjet with a width of 5 inches was set as the sheet 2, and continuous image recording with an image size of 5×7 inches was performed. At this time, the temperature of the atmosphere around the inkjet recording apparatus was 25° C., and the relative humidity was 55%. When the moisture content rate of the roll paper was measured using an electrical moisture meter (Main body: MR-200, Probe: KG-PA) made by Sanko Electronic Laboratory Co., Ltd. about the moisture content rate of the roll paper which is the sheet 2, the moisture content was about 6%. After the ink within the nozzles was refreshed by performing "discarding discharge" of a recording head 1 within a cap prior to recording of an image, the cap was evacuated, and the recording head 1 was moved to an image recording position.

In parallel to a series of the above operations, gas with a temperature of 30° C. and a relative humidity of 85% began to be delivered into the recording unit 9 at 0.2 m/sec by the second supply unit 3. At this time, the wind speed under the recording head 1 was 0.9 m/sec, and this speed was a flow velocity at which problems, such as deterioration of landing accuracy of the main drop or negative effects on an image formed when a satellite drop is separated from the main drop and lands on the target, do not occur. In addition, since the dew point of gas of which the temperature is 30° C. and the relative humidity is 85% is 27° C., supply of the humidified gas by the second supply unit 3 was started after the temperature within the recording apparatus exceeded 27° C. after the start of operation of the inkjet recording apparatus. As for the specific atmosphere within the recording apparatus, the temperature was 32° C., and the relative humidity was 37%. Within the inkjet recording apparatus, the temperature within the apparatus rises due to the temperature control of the recording heads 1, the use of a dryer or the like. However, if the temperature outside the apparatus is low, as in winter, substantial time is taken until the apparatus gets warm, a warming unit, such as a heater, may be separately provided within the apparatus.

Next, the gas humidified to a temperature of 30° C. and a relative humidity of 85% (an absolute humidity of 25.8 g/m$^3$) was supplied to the surface of the roll paper via a supply port 43 of 150×40 mm at 1.3 m/sec by the first supply unit 4. In addition, the amount of moisture supplied to the roll paper at this time is about 0.2 g/sec, and the amount of moisture supplied increases at about 720 g per hour. In such a case, as described above, the gas supplied from the supply port 43 desirably constitutes a circulation system such that the gas returns to the intake port 44. When the moisture content rate of the roll paper humidified by the first supply unit 4 was measured, the moisture content was about 13%.

In a state where the gas humidified from the first supply unit 4 and the second supply unit 3 was supplied in this way, the temperature and relative humidity near the tips of the recording heads 1 were measured. As a result, in the recording head 1 on the furthest upstream side, the temperature was 30° C., and the relative humidity was 80%, and in the recording head 1 on the furthest downstream side, the temperature was 30° C. and the relative humidity have was 75%. Therefore, it turned out that the entire region where the recording heads 1 were arranged was humidified.

Figure 6:
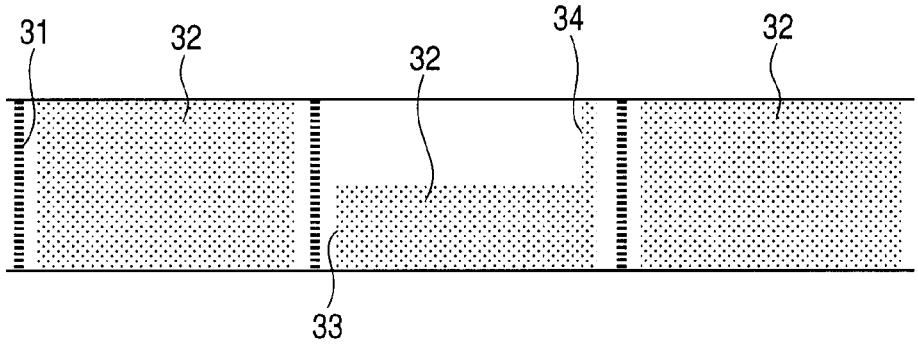
FIG. 6 is a typical diagram of a recording image.
Figure 7A:
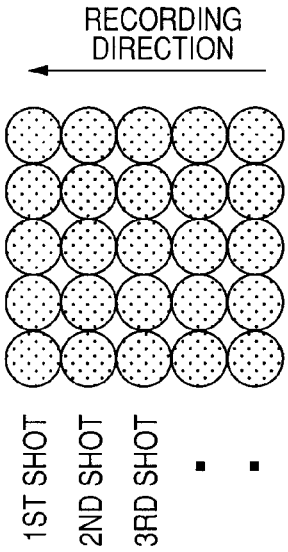
FIGS. 7A and 7B are enlarged schematic views of a writing portion of a recording image when recording has been performed.

Then, in this state, conveying of the glossy paper roll which is the sheet 2 was started, and as illustrated in FIG. 6, a plurality of kinds of recording image 32 including a recording image with an image size of 5×7 inches were recorded. Between the recording images 32, the "discarding discharge 31" was performed, and continuous recording was performed at a speed of 1.5 inches/sec. As a result, even in the writing portion 34 of the recording image 32 when the nozzles which were not used were used, an image without any problem in both the landing accuracy and concentration of a recording dot from a first shot was obtained, similarly to the writing portion 33 of the recording image 32 of the nozzles which were used (refer to FIG. 7A).

EXAMPLE 2

In Example 2, recording was performed on the sheet 2 by the same method as Example 1 except that gas of which the temperature is 40° C. and the relative humidity is 60% (absolute humidity of 30.6 g/m$^3$) was used as the gas humidified by the first supply unit 4. In addition, the amount of moisture supplies to the roll paper at this time is about 0.24 g/sec. When the moisture content rate of the roll paper humidified by the first supply unit 4 was measured, the moisture content was about 15%.

Additionally, in a state where the gas humidified from the first supply unit 4 and the second supply unit 3 was supplied, the temperature and relative humidity near the tip of the recording heads 1 were measured. As a result, in the recording head 1 on the furthest upstream side, the temperature was 30° C., and the relative humidity was 95%, and in the recording head 1 on the furthest downstream side, the temperature was 30° C. and the relative humidity have was 90%. Therefore, it turned out that the entire region where the recording heads 1 were arranged was humidified.

In this state, an image was recorded similarly to Example 1. As a result, similarly to the writing portion 33 of the recording image 32 of the nozzles which were used, even in the writing portion 34 of the recording image 32 when the nozzles which were not used were used, an image without any problems in both the landing accuracy and concentration of a recording dot from a first shot of the recording dot was obtained, (refer to FIG. 7A).

COMPARATIVE EXAMPLE 1

In Comparative Example 1, recording was performed on the roll sheet by the same method as Example 1 except that humidified gas was not supplied to the roll paper by the first supply unit 4, unlike Example 1. That is, almost the same conditions as the conventional technique (Japanese Patent Application Laid-Open No. 2000-255053) were used.

In a state where the gas humidified from the second supply unit 3 only was supplied, the temperature and relative humidity near the tips of the recording heads 1 were measured. As a result, in the recording head 1 on the furthest upstream side, the temperature was 30° C., and the relative humidity was 70%, and in the recording head 1 on the furthest downstream side, the temperature was 30° C. and the relative humidity have was 45%.

In Comparative Example 1, since moisture was not intentionally supplied to a roll paper by the first supply unit 3, the moisture in the gas within the recording unit 9 was absorbed by the roll paper, and the humidity near the tips of the recording heads 1 before the start of recording became lower than that of Example 1 and Example 2. The tendency becomes noticeable particularly near the tip of the recording head 1 on the furthest downstream side.

Figure 7B:
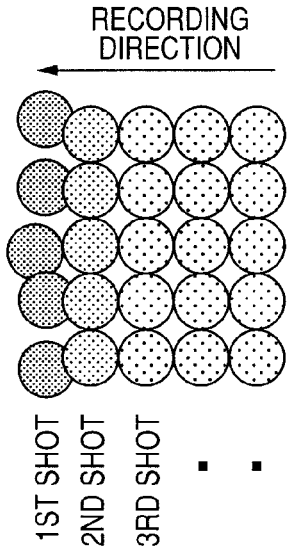

In this state, an image was recorded similarly to Example 1. As a result, an image (refer to FIG. 7A) without a problem in the writing portion 33 of the recording image 32 of the nozzles which were used was obtained. However, in the writing portion 34 of the recording image 32 when the nozzles which were not used were used, as illustrated in FIG. 7B, the landing accuracy of recording dots deteriorated, and an image which was not constant in concentration was obtained.

According to the recording apparatus related to the embodiments of the present invention described above, before a sheet is fed into the recording unit, moisture is supplied to the sheet from the first supply port, and the gas humidified by the second supply unit is supplied to the recording unit, thereby humidifying the peripheries of the recording heads. In this state, if the sheet is supplied to the recording unit, the sheet can be kept from absorbing the moisture around the recording heads. Therefore, during a recording operation, a space where nozzles are exposed from the recording head on the furthest upstream side to the recording head on the furthest downstream side is maintained at high atmosphere humidity, and the moisture in ink is kept form evaporating from the nozzles of the recording heads. In this way, even if the nozzles which were not used are used, the deterioration of the landing accuracy of recording dots or a change in tone can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-258799, filed Nov. 12, 2009, No. 2010-106622, filed May 6, 2010 and No. 2010-106717, field May 6, 2010 which are hereby incorporated by reference herein in their entirety.

What is claimed is:

1. A method of recording on a sheet using an inkjet type recording head in which nozzles are formed, the method comprising:

a first step of supplying a first humidified gas through a first supply port to a surface of the sheet on which an image is to be formed;

a second step of supplying a second humidified gas through a second supply port to a space where the nozzles are exposed; and a third step of performing, using the recording head, recording on a portion of the surface of the sheet which has entered the space where atmospheric humidity has been increased by the second step, after a moisture content of the portion of the surface of the sheet has been increased by the first step, wherein a plurality of the recording heads are arranged along a direction in which the sheet is conveyed, wherein in the second step, at least a part of the second humidified gas supplied from the second supply port flows along the direction of sheet conveyance through a space that includes a gap between nozzles of the plurality of the recording heads and the sheet, and wherein a flow velocity of the second humidified gas is set to 1 m/sec or less at the gap.

2. The method according to claim 1, wherein the absolute humidity of the first humidified gas is higher than the absolute humidity of the second humidified gas.

3. The method according to claim 1, wherein in the first step, the sheet is humidified by the first humidified gas until a moisture content of the sheet is in equilibrium with atmospheric humidity.

4. The method according to claim 1, further comprising:

a decurling step of decurling the sheet, wherein the sheet is a continuous sheet wound in a shape of a roll, and the first humidified gas is supplied to a decurled portion of the sheet.

5. An image recording apparatus comprising:

a humidifying unit for generating humidified gas;

a recording unit that includes an inkjet type recording head in which nozzles are formed;

a first supply port configured to supply a first humidified gas to a surface of a sheet on which an image is to be formed;

a second supply port configured to supply a second humidified gas to a space where the nozzles are exposed, wherein the second supply port is provided at a position between the recording head and the first supply port in a direction in which the sheet is conveyed;

a recovery duct for recovering at least a part of the first humidified gas supplied from the first supply port, and reintroducing the recovered gas into the humidifying unit, wherein the recording unit includes a plurality of the recording heads arranged along the direction, and wherein at least a part of the second humidified gas supplied from the second supply port flows along the direction through a space that includes a gap between nozzles of the plurality of the recording heads and the sheet.

6. The apparatus according to claim 5, further comprising:

a decurling mechanism configured to decurl the sheet, and which is provided further upstream from a position where the first supply port supplies the first humidified gas, wherein the sheet is a continuous sheet wound in a shape of a roll.

7. The apparatus according to claim 6, wherein the decurling mechanism includes a heater for heating the sheet during decurling.

8. The apparatus according to claim 5, further comprising:

a return duct for recovering at least a part of the second humidified gas from the space, and reintroducing the recovered gas into the humidifying unit.

9. The apparatus according to claim 5, wherein the humidifying unit includes a first humidification chamber for generating humidified gas and a second humidification chamber connected to the first humidification chamber, and the humidified gas generated in the first humidification chamber is introduced into the second humidification chamber, and humidified gas further humidified in the second humidification chamber is generated.

10. The apparatus according to claim 9, wherein the first humidification chamber and the second humidification chamber are partitioned by a wall and provided inside a housing of the humidifying unit, and water for humidification is shared by the first humidification chamber and the second humidification chamber and accumulates at the bottom of the first humidification chamber and the bottom of the second humidification chamber.

11. The apparatus according to claim 10, wherein the first humidification chamber includes a first heating element, a first humidification filter, and a first fan, and the second humidification chamber includes a second heating element, a second humidification filter, and a second fan, wherein a gas introduced from an inlet provided in the housing is raised in temperature by the first heating element in the first humidification chamber, humidified by the first humidification filter, and fed to the second humidification chamber by the first fan, and then, is raised in temperature by the second heating element in the second humidification chamber, further humidified by the second humidification filter, and exhausted from a outlet provided in the housing by the second fan.

12. An image recording apparatus comprising:

a humidifying unit for generating humidified gas;

a recording unit that includes an inkjet type recording head in which nozzles are formed;

a first supply port configured to supply a first humidified gas to a surface of a sheet on which an image is to be formed;

a second supply port configured to supply a second humidified gas to a space where the nozzles are exposed, wherein the second supply port is provided at a position between the recording head and the first supply port in a direction in which the sheet is conveyed; and a return duct for recovering at least a part of the second humidified gas from the space, and reintroducing the recovered gas into the humidifying unit;

wherein the recording unit includes a plurality of the recording heads arranged along the direction, and wherein at least a part of the second humidified gas supplied from the second supply port flows along the direction through a space that includes a gap between nozzles of the plurality of the recording heads and the sheet.

13. A method of recording on a sheet using an inkjet type recording head in which nozzles are formed, the method comprising:

a first step of supplying a first humidified gas through a first supply port to the sheet;

a second step of supplying a second humidified gas through a second supply port to a space where the nozzles are exposed, wherein an absolute humidity of the first humidified gas is higher than an absolute humidity of the second humidified gas; and a third step of performing, using the recording head, recording on a portion of the sheet which has entered the space where atmospheric humidity has been increased by the second step, after a moisture content of the portion of the sheet has been increased by the first step.

14. An image recording apparatus comprising:

a recording unit that includes an inkjet type recording head in which nozzles are formed;

a first supply port configured to supply a first humidified gas to a sheet on which an image is to be formed; and a second supply port configured to supply a second humidified gas to a space where the nozzles are exposed, wherein the second supply port is provided at a position between the recording head and the first supply port in a direction in which the sheet is conveyed, and wherein an absolute humidity of the first humidified gas is higher than an absolute humidity of the second humidified gas.

* * * * *